US010279458B2

(12) United States Patent
Li

(10) Patent No.: US 10,279,458 B2
(45) Date of Patent: May 7, 2019

(54) REVERSIBLE RATCHET WRENCH WITHOUT SWITCH KNOB

(71) Applicant: HUA WEI TOOLS CO., LTD., Taichung (TW)

(72) Inventor: Zhong-Song Li, Taichung (TW)

(73) Assignee: HUA WEI TOOLS CO., LTD., Taichung (TW)

( * ) Notice: Subject to any disclaimer, the term of this patent is extended or adjusted under 35 U.S.C. 154(b) by 121 days.

(21) Appl. No.: 15/586,614

(22) Filed: May 4, 2017

(65) Prior Publication Data

US 2018/0297177 A1 Oct. 18, 2018

(30) Foreign Application Priority Data

Apr. 12, 2017 (TW) ..... 106112163 A

(51) Int. Cl.
*B25B 13/46* (2006.01)

(52) U.S. Cl.
CPC ..... *B25B 13/463* (2013.01)

(58) Field of Classification Search
CPC ..... B25B 13/463
USPC ..... 81/58.3, 63.2, 63, 467
See application file for complete search history.

(56) References Cited

U.S. PATENT DOCUMENTS 4,270,417 A * 6/1981 Tesoro ..... B25B 13/466 81/58.3
5,709,137 A * 1/1998 Blacklock ..... A61C 8/0089 81/467
6,134,990 A * 10/2000 Ling ..... B25B 13/463 81/60
6,408,722 B1 * 6/2002 Chen ..... B25B 13/463 81/60
6,415,691 B1 * 7/2002 Chen ..... B25B 13/463 81/63
6,807,882 B2 * 10/2004 Hu ..... B25B 13/463 81/58
6,874,391 B2 * 4/2005 Hsien ..... B25B 13/463 81/60
7,444,903 B1 * 11/2008 Li ..... B25B 13/463 81/60
7,823,484 B1 * 11/2010 Chen ..... B25B 13/463 81/177.9
8,616,095 B2 * 12/2013 Chi ..... B25B 13/463 81/58.5
8,943,928 B2 * 2/2015 Feng ..... B25B 13/463 81/60

(Continued)

*Primary Examiner* — Sean K. Hunter
*Assistant Examiner* — Thomas Raymond Rodgers
(74) *Attorney, Agent, or Firm* — Ming Chow; Sinorica, LLC

(57) ABSTRACT

A reversible ratchet wrench without a switch knob has a handle portion and a head portion. The head portion has an accommodation trough, a detent trough, and a blind hole. A ratchet wheel is disposed in the accommodation trough and displaceable in the accommodation trough toward the handle portion to form a first position and a second position. A detent is disposed in the detent trough. Left and right sides of one surface of the detent are formed with push portions, respectively. An elastic member is disposed in the blind hole and pressed against one of the push portions. For a reverse switch, the ratchet wheel is displaced to the second position and then the ratchet wheel is turned, so that the elastic member is pressed against the other push portion.

9 Claims, 15 Drawing Sheets

(56) References Cited

U.S. PATENT DOCUMENTS

| | | | | |
|---|---|---|---|---|
| 9,327,389 | B2 * | 5/2016 | Chen | B25B 13/463 |
| 2002/0062718 | A1 * | 5/2002 | Wang | B25B 13/463<br>81/60 |
| 2003/0150300 | A1 * | 8/2003 | Hu | B25B 13/461<br>81/63.2 |
| 2004/0216565 | A1 * | 11/2004 | Chen | B25B 13/463<br>81/63.2 |
| 2006/0219062 | A1 * | 10/2006 | Liu | B25B 13/463<br>81/63 |
| 2008/0034926 | A1 * | 2/2008 | Chaconas | B25B 13/462<br>81/58.4 |
| 2011/0162488 | A1 * | 7/2011 | Chan | B25B 13/463<br>81/63 |

* cited by examiner

REVERSIBLE RATCHET WRENCH WITHOUT SWITCH KNOB

FIELD OF THE INVENTION

The present invention relates to a ratchet wrench, and more particularly to a reversible ratchet wrench without a switch knob.

BACKGROUND OF THE INVENTION

FIG. 1 is an exploded view of a conventional ratchet wrench. The ratchet wrench comprises a main body 200, a ratchet wheel 210, a detent 220, and a switch knob 230. The main body 200 has a first accommodation trough 201, a second accommodation trough 202, and a third accommodation trough 203. The ratchet wheel 210 is disposed in the first accommodation trough 201. The outer peripheral wall of the ratchet wheel 210 is provided with a toothed portion 211. The detent 220 is disposed in the second accommodation trough 202. One side of the detent 220 is provided with meshing teeth 221. The meshing teeth 221 are adapted to mesh with the toothed portion 211. The switch knob 230 is disposed in the third accommodation trough 203. The switch knob 230 is provided with a lever 231 and an elastic member 232. When the switch knob 230 is turned in the third accommodation trough 203 of the main body 200, the switch knob 230 drives the elastic member 232 to turn at an angle. The elastic member 232 urges the detent 22 to offset in the second accommodation trough 202, so that the ratchet wrench can be switched for a forward rotation or a reverse rotation to facilitate the user's operation.

However, the conventional ratchet wrench has a complicated structure, and its reversing device is small in size and difficult to assemble and position. The switch knob 230 is connected with the exposed lever 232 by riveting. The user can switch the switch knob 230 to change the direction of turning. The conventional ratchet wrench has too many parts, and the assembly of the parts is extremely complicated. When the user wants to perform a reversing operation, the user usually holds the main body 200 with one hand and turns the switch knob 230 with the other hand. The reversing operation cannot be implemented with one hand only. The conventional ratchet wrench increases the production cost and working hours. Accordingly, the inventor of the present invention has devoted himself based on his many years of practical experiences to solve these problems.

SUMMARY OF THE INVENTION

The primary object of the present invention is to provide a reversible ratchet wrench without a switch knob. Its structure is simple. There is no need to use a switch knob to complete the reversing operation with one hand, thereby reducing production costs and working hours.

In order to achieve the aforesaid object, the reversible ratchet wrench without a switch knob of the present invention comprises a wrench body. The wrench body has a handle portion. One end of the handle portion is connected with a head portion. The head portion has an accommodation trough and a detent trough communicating with the accommodation trough. The ratchet trough is provided with a blind hole in the direction of the handle portion. A ratchet wheel is disposed in the accommodation trough. An outer peripheral surface of the ratchet wheel is provided with a plurality of drive teeth. The ratchet wheel is displaceable in the accommodation trough toward the handle portion to form a first position and a second position. The ratchet wheel is normally located at the first position. When the ratchet wheel is located at the second position, the ratchet wheel is displaced toward the handle portion. A detent is disposed in the detent trough. One side of the detent, facing the ratchet wheel, is provided with a toothed surface. The toothed surface is provided with a plurality of detent teeth. The detent teeth are configured to mesh with the drive teeth. Another side of the detent is provided with a limit surface. Left and right sides of the limit surface are formed with push portions, respectively. An elastic member is disposed in the blind hole. The elastic member is pressed against the limit surface. When the ratchet wheel is at the first position, the elastic member is pressed against one of the push portions of the limit surface. When the ratchet wheel is at the second position, the ratchet wheel drives the detent to compress the elastic element.

For a reverse switch, the ratchet wheel is displaced to the second position to compress the elastic member and then the ratchet wheel is turned to drive the detent to move toward the left or the right, so that the elastic member is pressed against the other push portion of the limit surface to complete the reverse switch.

DETAILED DESCRIPTION OF THE PREFERRED EMBODIMENTS

Embodiments of the present invention will now be described, by way of example only, with reference to the accompanying drawings.

Figure 1:
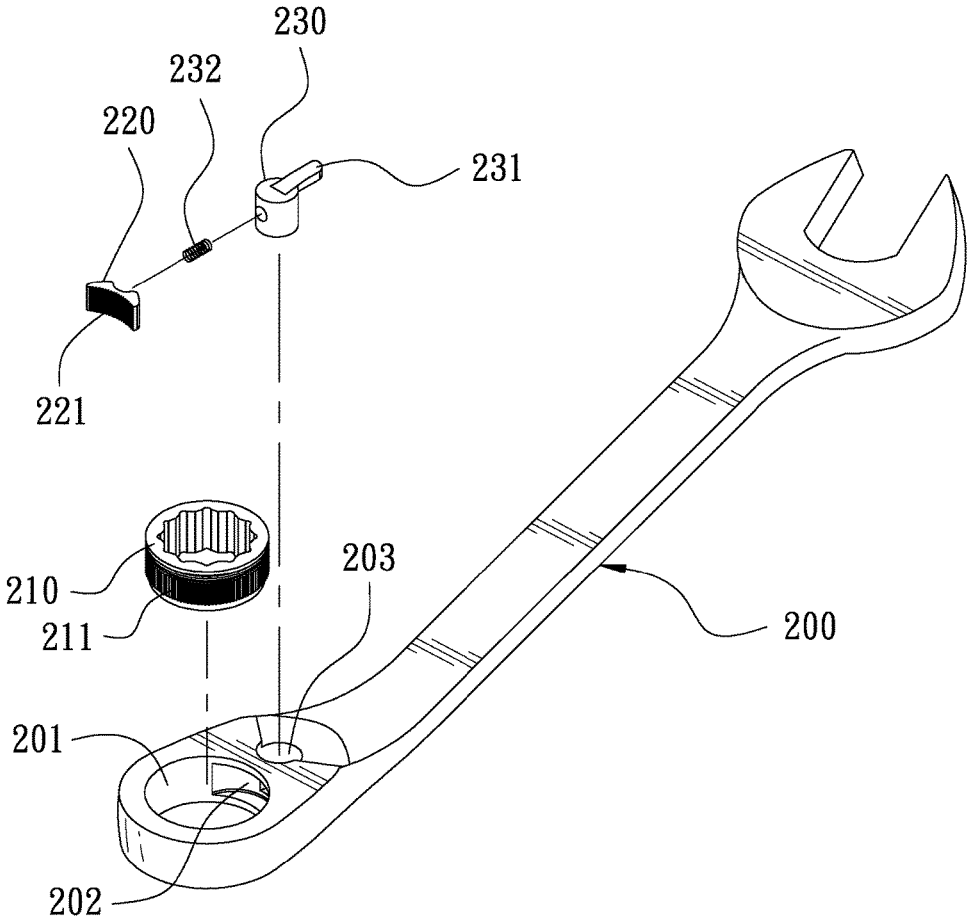
FIG. 1 PRIOR ART
FIG. 1 is an exploded view of a conventional ratchet wrench.
Figure 2:
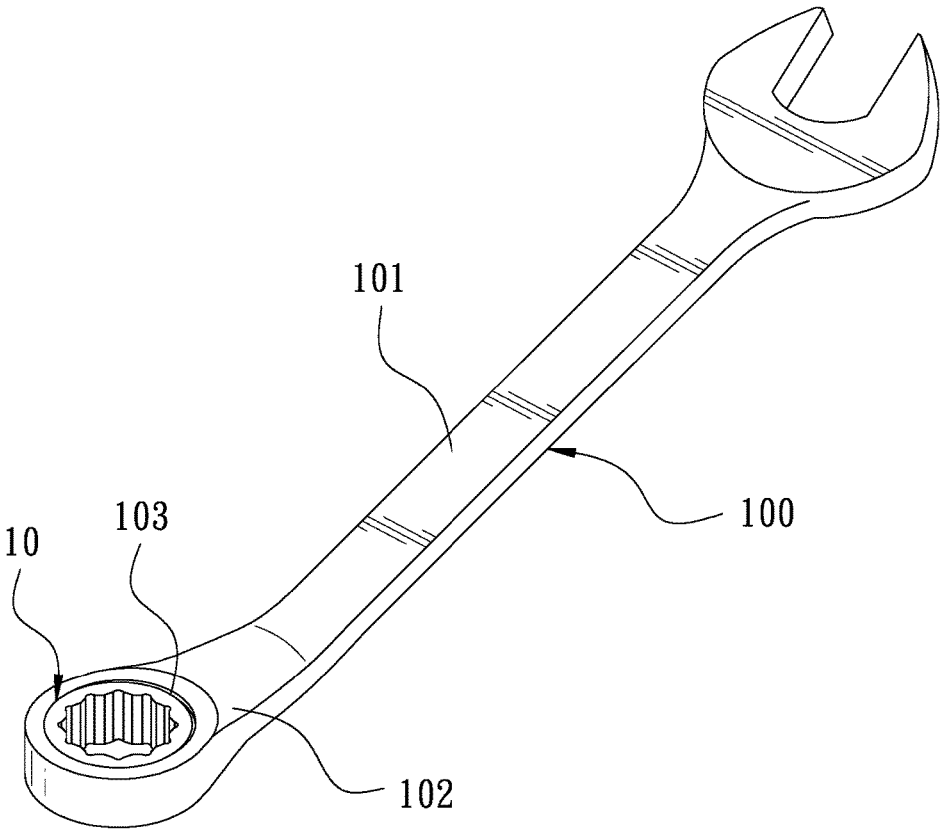
FIG. 2 is a perspective view in accordance with a first embodiment of the present invention.
Figure 3:
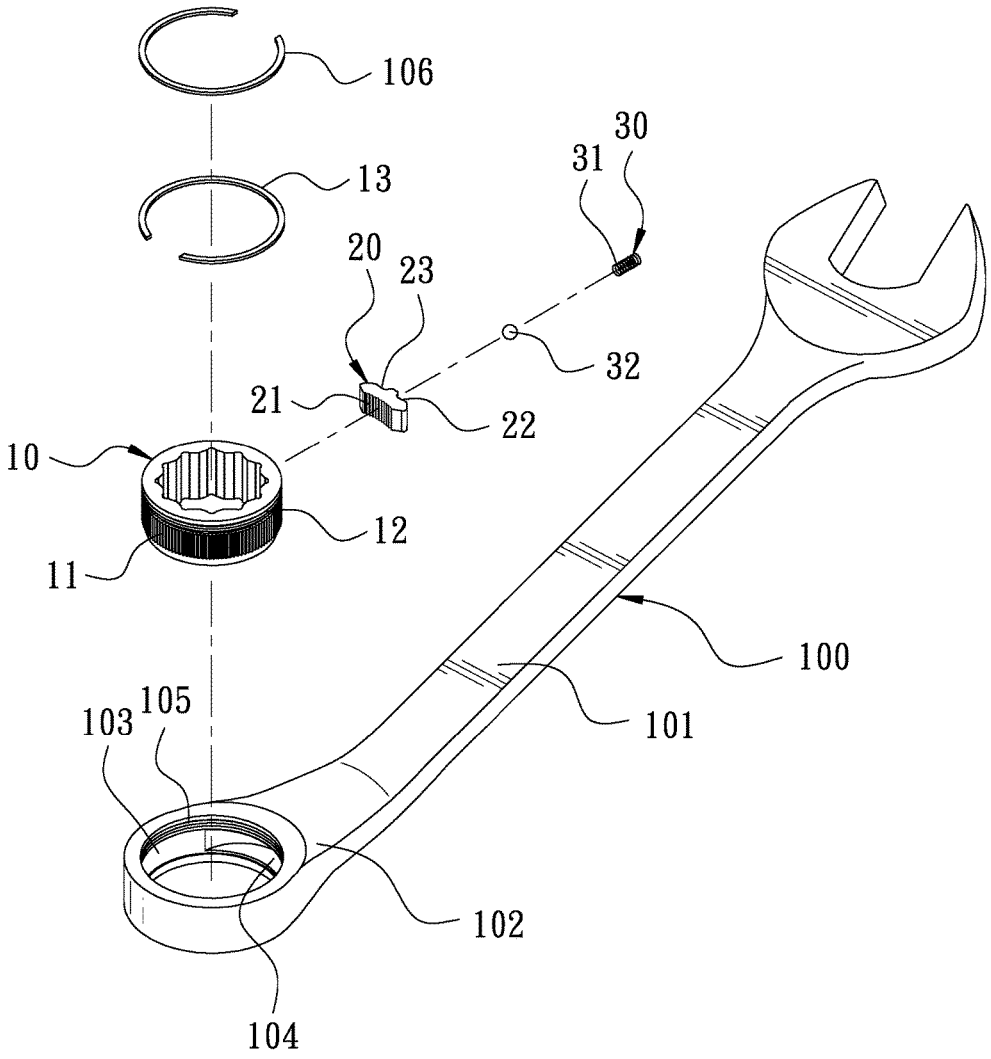
FIG. 3 is an exploded view in accordance with the first embodiment of the present invention.
Figure 4:
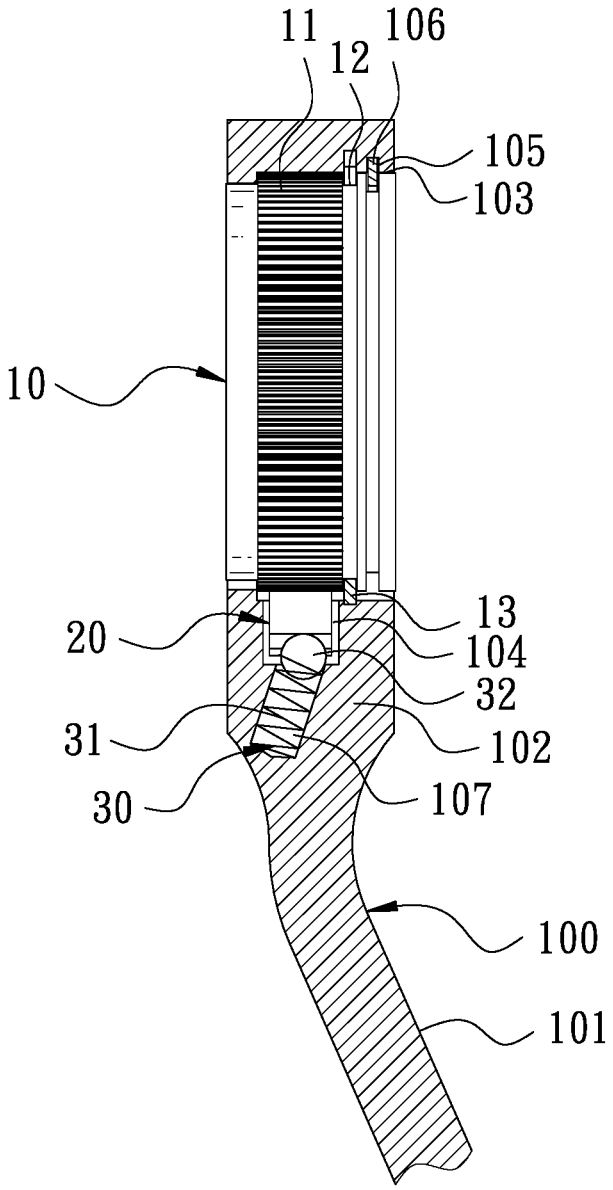
FIG. 4 is a longitudinal sectional view in accordance with the first embodiment of the present invention.

FIG. 2 is a perspective view in accordance with a first embodiment of the present invention. FIG. 3 is an exploded view in accordance with the first embodiment of the present invention. FIG. 4 is a longitudinal sectional view in accordance with the first embodiment of the present invention. The present invention discloses a reversible ratchet wrench without a switch knob. The reversible ratchet wrench comprises a wrench body 100. The wrench body 100 has a handle portion 101. One end of the handle portion 101 is connected with a head portion 102. The head portion 102 has an accommodation trough 103 and a detent trough 104 communicating with the accommodation trough 103. The accommodation trough 103 may be in a circular shape, an elliptical shape, or a non-circular shape. In this embodiment, the accommodation trough 103 is elliptical in shape. The accommodation trough 103 is circumferentially formed with a first annular groove 105. The first annular groove 105 is provided with a positioning snap ring 106. The detent trough 104 is a crescent-shaped trough. The detent trough 104 is provided with a blind hole 107 in the direction of the handle portion 101.

Figure 5:
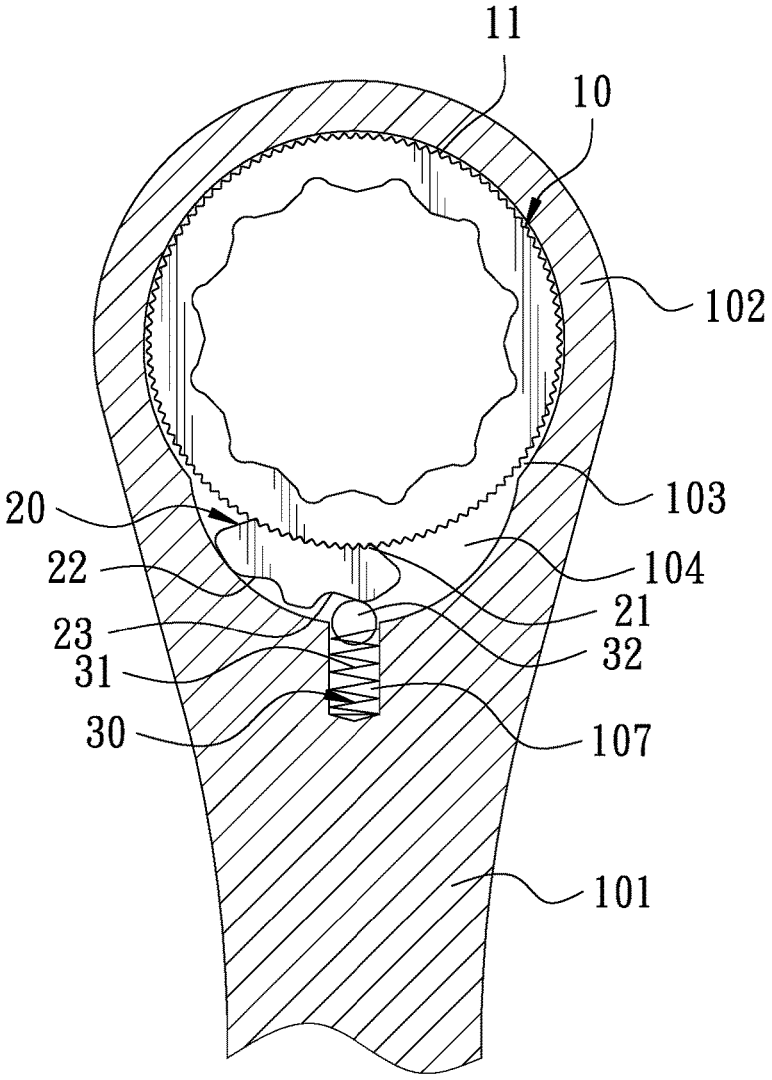
FIG. 5 is a lateral sectional view in accordance with the first embodiment of the present invention.
Figure 6:
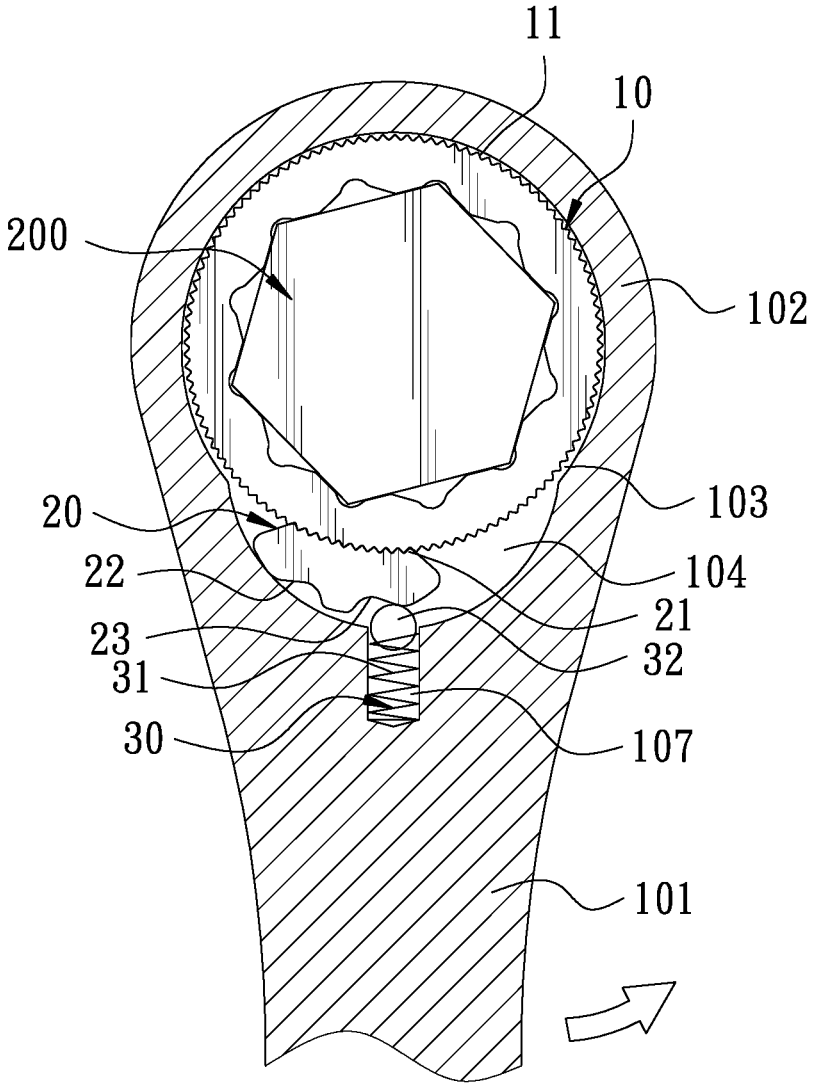
FIG. 6 is a sectional view in accordance with the first embodiment of the present invention, showing the ratchet wheel is fitted on a bolt.

A ratchet wheel 10 is positioned in the accommodation trough 103 by the positioning snap ring 106. The outer peripheral surface of the ratchet wheel 10 is provided with a plurality of drive teeth 11. The ratchet wheel 10 is circumferentially formed with a second annular groove 12. The accommodation trough 103 is provided with a C-shaped buckle 13 corresponding to the second annular groove 12. The ratchet wheel 10 is displaceable in the accommodation trough 103 toward the handle portion 101 to form a first position and a second position. The ratchet wheel 10 is normally located at the first position (as shown in FIG. 5). When the ratchet wheel 10 is located at the second position (as shown in FIG. 6), the ratchet wheel 10 is displaced toward the handle portion 101.

FIG. 5 is a lateral sectional view in accordance with the first embodiment of the present invention. A detent 20 is disposed in the detent trough 104. One side of the detent 20, facing the ratchet wheel 10, is provided with a toothed surface 21. The toothed surface 21 is provided with a plurality of detent teeth. The detent teeth are configured to mesh with the drive teeth 11. Another side of the detent 20 is provided with a limit surface 22. Left and right sides of the limit surface 22 are formed with push portions 23, respectively. In this embodiment, the push portions 23 each have a concave shape.

An elastic member 30 is disposed in the blind hole 107. The elastic member 30 is pressed against the limit surface 22. In this embodiment, the elastic member 30 includes a spring 31 and a steel ball 32. The spring 31 is fitted with the ball 32, and the ball 32 is pressed against the limit surface 22. When the ratchet wheel 10 is at the first position, the elastic member 30 is pressed against one of the push portions 23 of the limit surface 22. When the ratchet wheel 10 is at the second position, the ratchet wheel 10 drives the detent 20 to compress the elastic element 30.

As shown in FIG. 6 to FIG. 10, when in use, the ratchet wheel 10 is fitted on a bolt 200, and then the handle portion 101 is turned toward the left or the right to fasten the bolt 200 tightly. In this embodiment, since the detent 20 abuts against the left wall of the detent trough 104, when the handle portion 101 is tuned toward the right, the ratchet wheel 10 will rotate and fasten the bolt 200. When the handle portion 101 is tuned toward the left, the ratchet wheel 10 will be idle.

Figure 7:
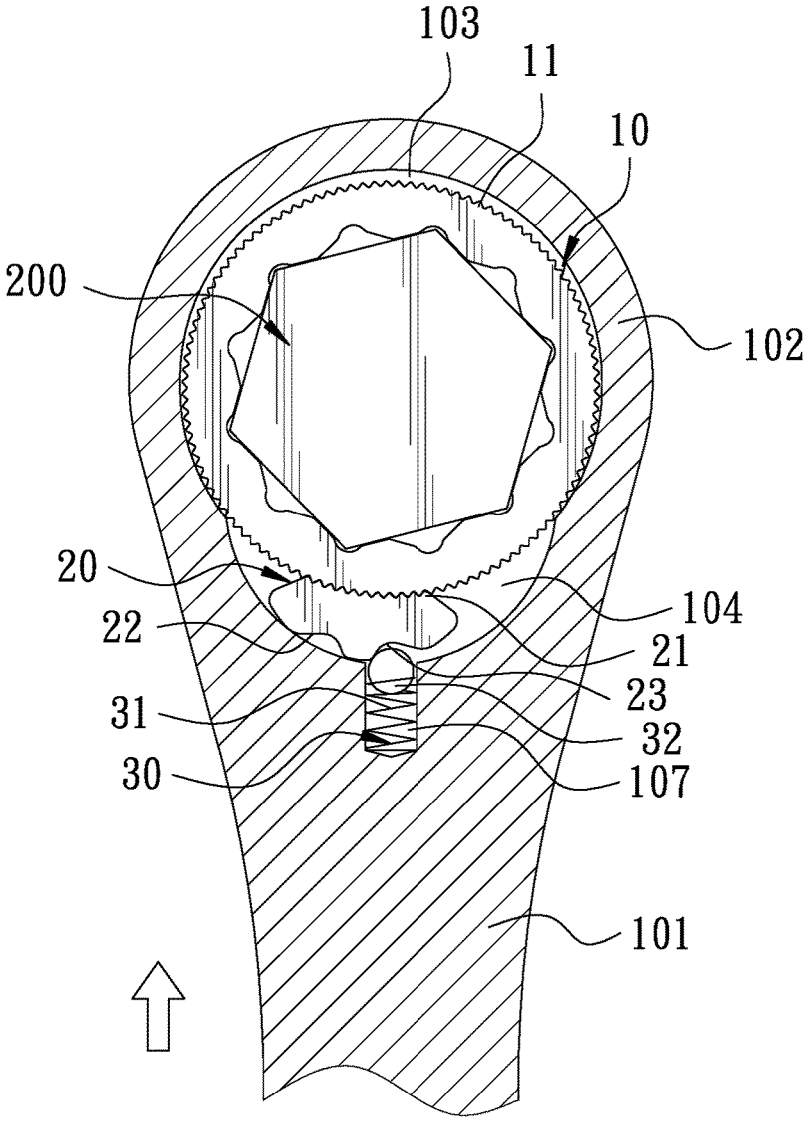
FIG. 7 is a sectional view in accordance with the first embodiment of the present invention, showing the ratchet wheel is pressed downward.

Next, referring to FIG. 7, when the user needs to perform a reversing operation, the handle portion 101 is grasped and pushed against the bolt 200 in the direction of the head portion 102. Since the bolt 200 is in an immovable state, and the ratchet wheel 10 is circular in shape but the accommodation trough 103 is a non-circular trough so that the ratchet wheel 10 is displaceable in the accommodation trough 103 in the direction of the handle portion 102. When the ratchet wheel 10 is moved to the second position, the ratchet wheel 10 drives the detent 20 to compress the elastic member 30.

Figure 8:
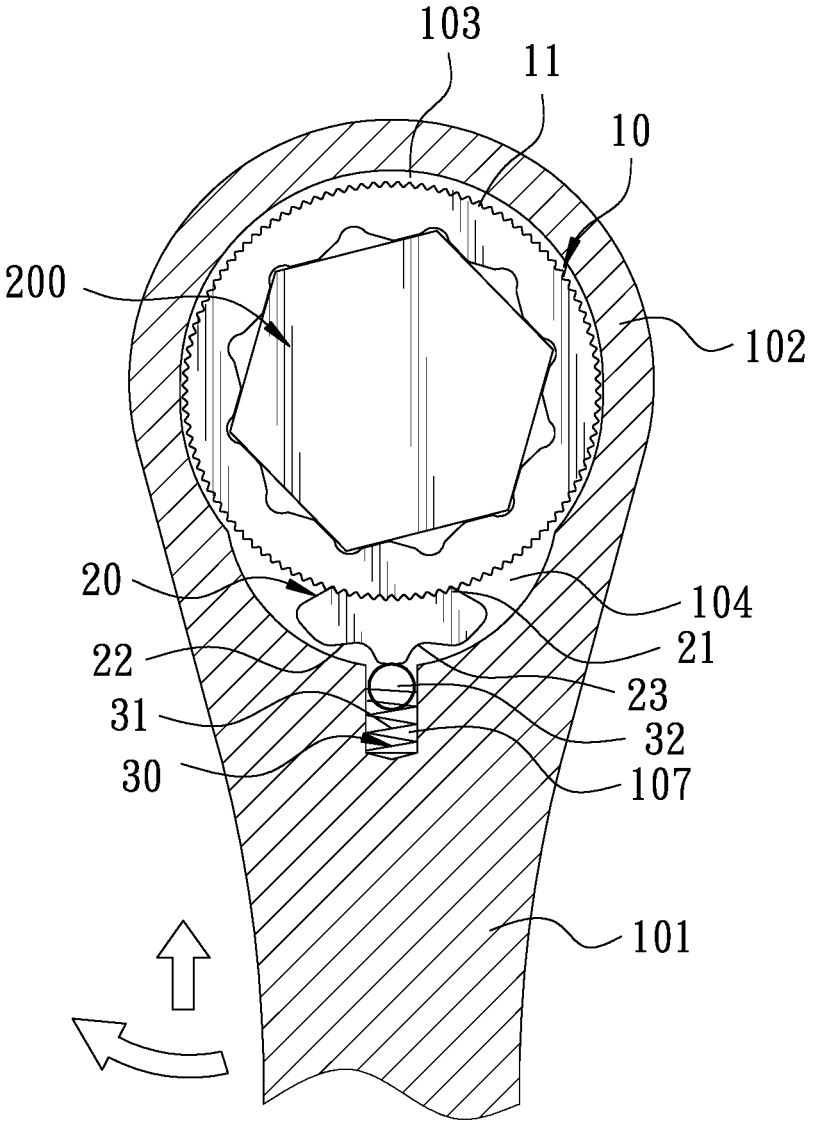
FIG. 8 is a sectional view in accordance with the first embodiment of the present invention, showing the ratchet wheel is turned.
Figure 9:
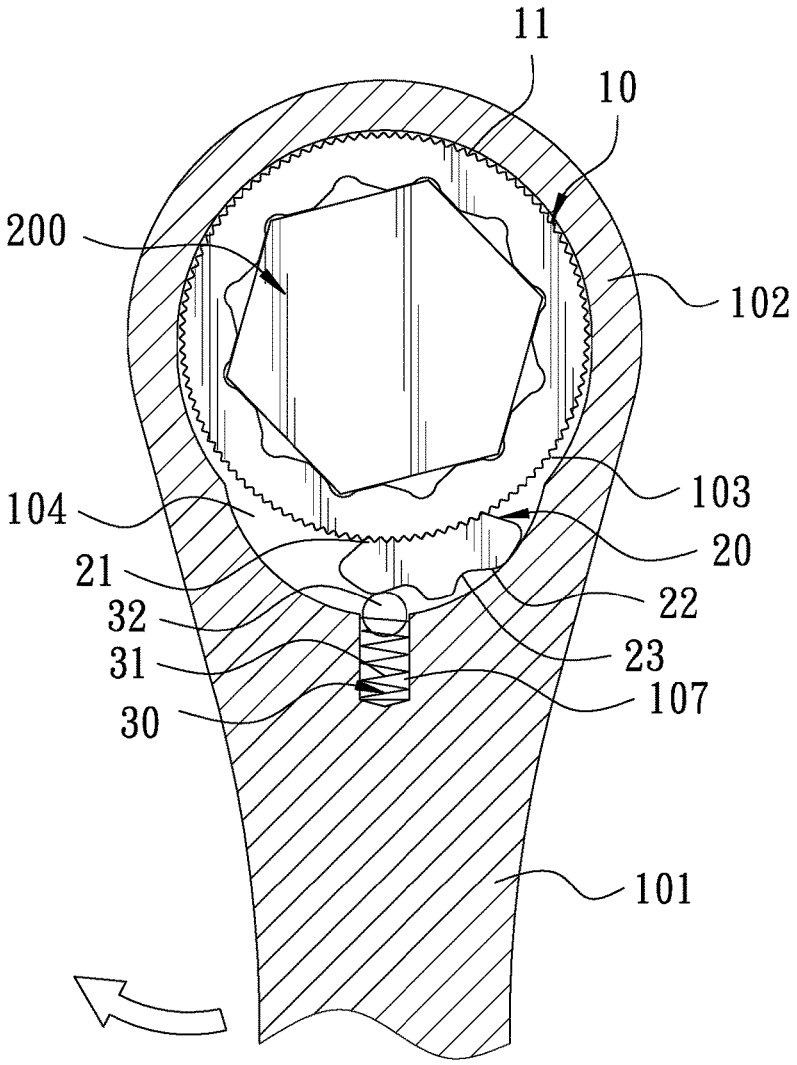
FIG. 9 is a sectional view in accordance with the first embodiment of the present invention, showing a reverse switch.
Figure 10:
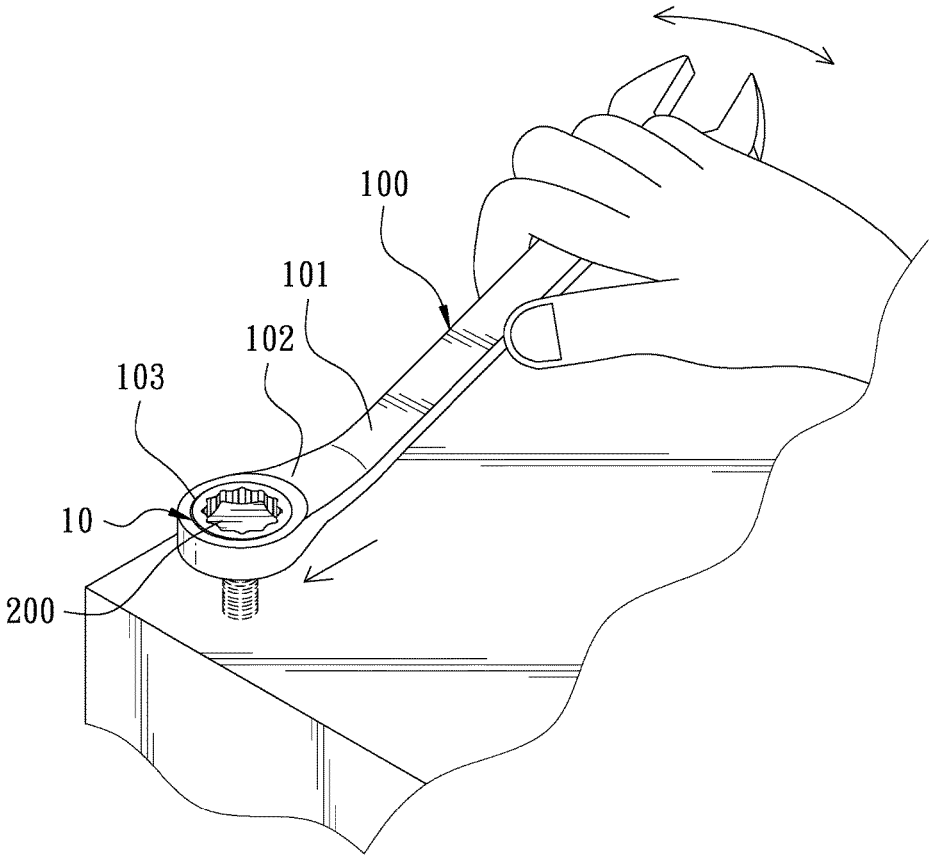
FIG. 10 is a schematic view in accordance with the first embodiment of the present invention when in use, showing the reversible operation.

Next, as shown in FIG. 8 and FIG. 9, the user turns the handle portion 101, enabling the ratchet wheel 10 to move the detent 20 to the left or the right. In this embodiment, the ratchet wheel 10 drives the detent 20 to the right, so that the elastic member 30 abuts against the other push portion 23 of the limit surface 22, and then the ratchet wheel 10 is returned to the first position. There is no need to use a switch knob, and the reversing operation can be implemented with one handle. At this time, when the handle portion 101 is tuned toward the left, the ratchet wheel 10 will rotate and fasten the bolt 200. When the handle portion 101 is tuned toward the right, the ratchet wheel 10 will be idle.

Figure 11:
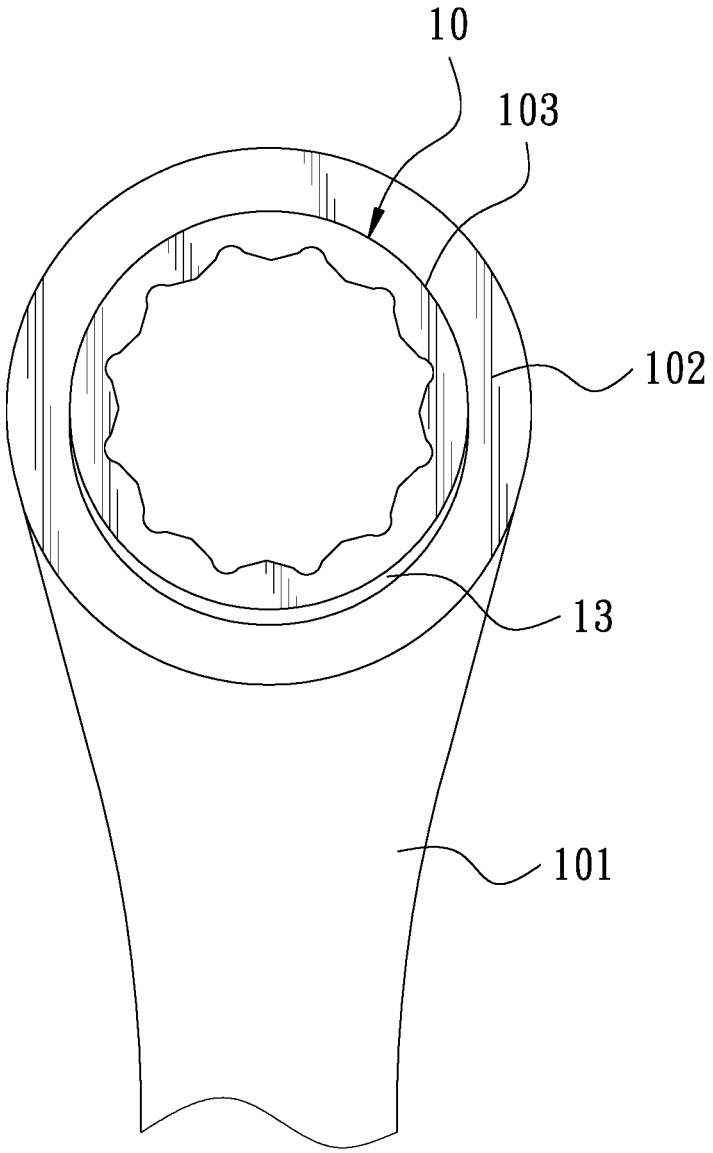
FIG. 11 is a front view in accordance with the first embodiment of the present invention, showing the shielding effect of the C-shaped buckle.

FIG. 11 is a front view in accordance with the first embodiment of the present invention, showing the shielding effect of the C-shaped buckle. Since the accommodation trough 103 is a non-circular trough, a gap is formed between the accommodation trough 103 and the ratchet wheel 10, resulting in a poor appearance. In order to improve this condition, the ratchet wheel 10 is circumferentially formed with the second groove 12 (see FIG. 3) and the accommodation trough 103 is provided with the C-shaped buckle 13 corresponding to the second annular groove 12, so that the C-shaped buckle 13 is adapted to block the gap so as to improve the appearance.

Figure 12:
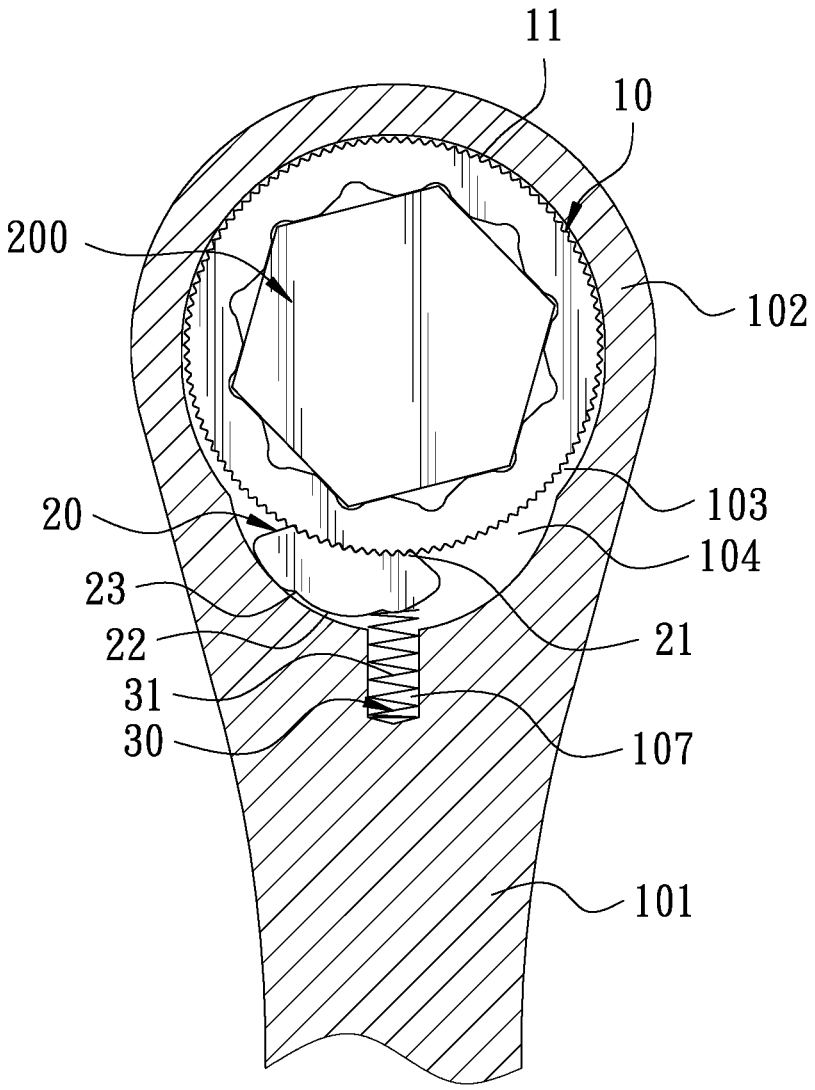
FIG. 12 is a sectional view in accordance with a second embodiment of the present invention.

FIG. 12 is a sectional view in accordance with a second embodiment of the present invention. The second embodiment is substantially similar to the first embodiment with the exceptions described hereinafter. The elastic member 30 is a spring 31, and the push portion 23 of the detent 20 is less concave to facilitate the spring 31 to hold against the detent 20 to achieve a simplified component and to reduce the cost of production.

Figure 13:
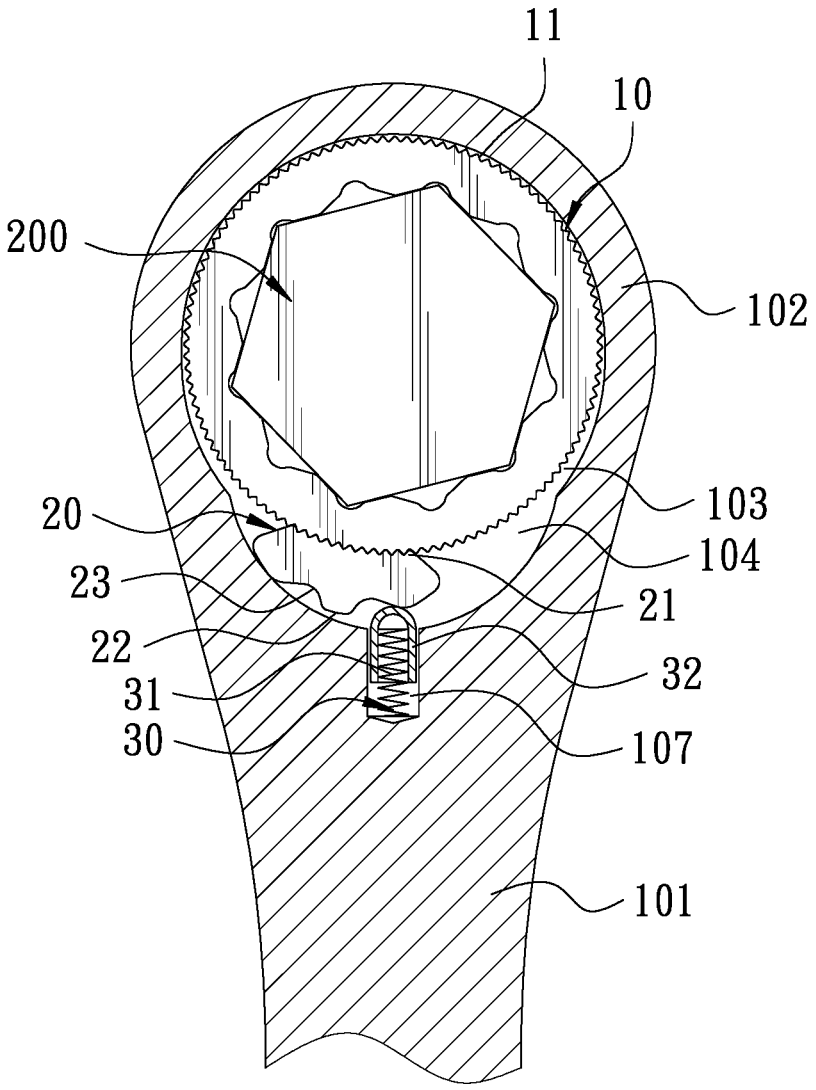
FIG. 13 is a sectional view in accordance with a third embodiment of the present invention.

FIG. 13 is a sectional view in accordance with a third embodiment of the present invention. The difference between the third embodiment and the first embodiment is that the steel ball 32 has a cylindrical shape.

Figure 14:
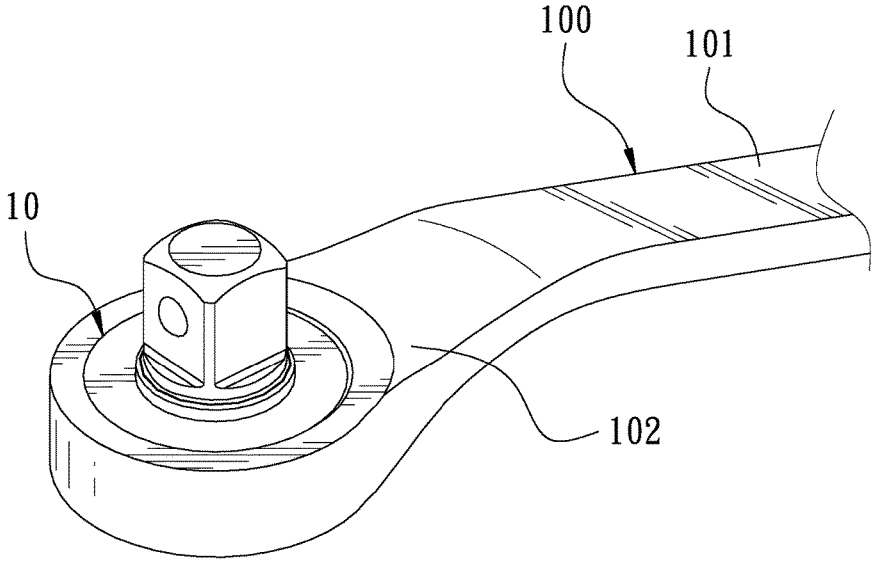
FIG. 14 is a sectional view in accordance with a fourth embodiment of the present invention.

FIG. 14 is a sectional view in accordance with a fourth embodiment of the present invention. The difference between the fourth embodiment and the first embodiment is that the wrench body 100 is an H-shaped ratchet wrench.

Figure 15:
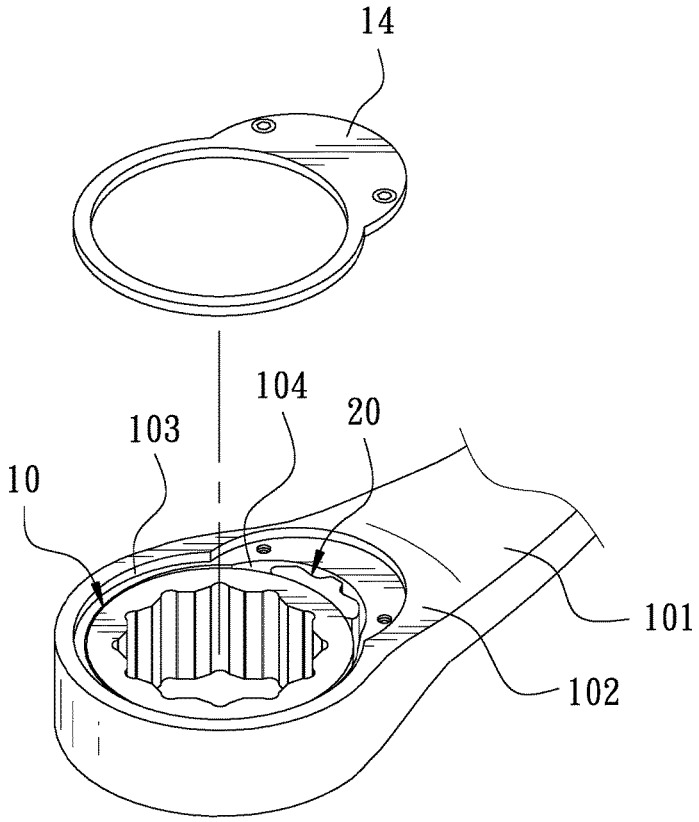
FIG. 15 is a sectional view in accordance with a fifth embodiment of the present invention.

FIG. 15 is a sectional view in accordance with a fifth embodiment of the present invention. The fifth embodiment is substantially similar to the first embodiment with the exceptions described hereinafter. The head portion 102 is further provided with a detachable outer cover 14. The outer cover 14 is configured to cover the accommodation trough 103 to facilitate replacement of the parts.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A reversible ratchet wrench without a switch knob, comprising a wrench body, the wrench body having a handle portion, one end of the handle portion being connected with a head portion, characterized by:

the head portion having an accommodation trough and a detent trough communicating with the accommodation trough, the detent trough being provided with a blind hole in the direction of the handle portion;

a ratchet wheel, disposed in the accommodation trough, an outer peripheral surface of the ratchet wheel being provided with a plurality of drive teeth, the ratchet wheel being displaceable in the accommodation trough toward the handle portion to form a first position and a second position, the ratchet wheel being normally located at the first position, wherein when the ratchet wheel is located at the second position, the ratchet wheel is displaced toward the handle portion;

a detent, disposed in the detent trough, one side of the detent, facing the ratchet wheel, being provided with a toothed surface, the toothed surface being provided with a plurality of detent teeth, the detent teeth being meshed with the drive teeth, another side of the detent being provided with a limit surface, left and right sides of the limit surface being formed with push portions, respectively;

an elastic member, disposed in the blind hole, the elastic member being pressed against the limit surface, wherein when the ratchet wheel is at the first position, the elastic member is pressed against one of the push portions of the limit surface, wherein when the ratchet wheel is at the second position, the ratchet wheel drives the detent to compress the elastic element;

wherein for a reverse switch, the user pushes the ratchet wheel to the second position to compress the elastic member and then the ratchet wheel is turned to drive the detent to move toward the left or the right, so that the elastic member is pressed against the other push portion of the limit surface to complete the reverse switch.

2. The reversible ratchet wrench as claimed in claim 1, wherein the accommodation trough is a non-circular trough, and the detent trough is a crescent-shaped trough.

3. The reversible ratchet wrench as claimed in claim 1, wherein the elastic member is a spring.

4. The reversible ratchet wrench as claimed in claim 1, wherein the elastic member includes a spring and a steel element, the spring is fitted with the ball, and the ball is pressed against the limit surface.

5. The reversible ratchet wrench as claimed in claim 4, wherein the steel element has a ball shape or a cylindrical shape.

6. The reversible ratchet wrench as claimed in claim 1, wherein the accommodation trough is circumferentially formed with a first annular groove, the first annular groove is provided with a positioning snap ring, and the positioning snap ring confines the ratchet wheel in the accommodation trough.

7. The reversible ratchet wrench as claimed in claim 1, wherein the ratchet wheel is circumferentially formed with a second annular groove, and the accommodation trough is provided with a C-shaped buckle corresponding to the second annular groove.

8. The reversible ratchet wrench as claimed in claim 1, wherein the head portion is provided with an outer cover, and the outer cover is configured to cover the accommodation trough.

9. The reversible ratchet wrench as claimed in claim 1, wherein the push portions each have a concave shape.

* * * * *